US006793072B2

(12) United States Patent
Maeng

(10) Patent No.: US 6,793,072 B2
(45) Date of Patent: Sep. 21, 2004

(54) BIASED, HINGED COVER FOR A GOLF CLUB

(76) Inventor: Seop Maeng, 104-601 Jeongdeun village 200 Jeongja-dong, Bundang-gu, Seongnam-city, Gyeonggi-do (KR)

( * ) Notice: Subject to any disclaimer, the term of this patent is extended or adjusted under 35 U.S.C. 154(b) by 0 days.

(21) Appl. No.: 10/281,938

(22) Filed: Oct. 28, 2002

(65) Prior Publication Data

US 2003/0121808 A1 Jul. 3, 2003

(30) Foreign Application Priority Data

Dec. 31, 2001 (KR) ..... 2001-89340

(51) Int. Cl.[7] ..... A63B 57/00

(52) U.S. Cl. ..... 206/315.2; 206/315.4; 150/160

(58) Field of Search ..... 206/315.2–315.4; 211/70.2; 150/160; 16/286

(56) References Cited

U.S. PATENT DOCUMENTS

| | | | | | |
|---|---|---|---|---|---|
| 216,777 | A | * | 6/1879 | Barry | 16/286 |
| 500,086 | A | * | 6/1893 | Van Wagoner | 16/286 |
| 2,128,546 | A | * | 8/1938 | Venmore | 211/70.2 |
| 2,508,525 | A | * | 5/1950 | Le Fevre | 150/160 |
| 3,117,609 | A | * | 1/1964 | Pio | 150/160 |
| 3,121,909 | A | * | 2/1964 | Young | 16/374 |
| 3,613,760 | A | * | 10/1971 | Koehnle | 150/160 |
| 3,892,267 | A | * | 7/1975 | Bibeau | 150/160 |
| 4,378,832 | A | * | 4/1983 | Thompson | 150/160 |
| 6,119,742 | A | * | 9/2000 | Maeng | 150/160 |
| 6,135,530 | A | * | 10/2000 | Blaszczak et al. | 296/37.8 |
| 6,192,950 | B1 | * | 2/2001 | Maeng | 150/160 |
| 6,202,723 | B1 | * | 3/2001 | Maeng | 150/160 |

FOREIGN PATENT DOCUMENTS

GB 2115294 A * 9/1983 ..... A63B/57/00

* cited by examiner

*Primary Examiner*—Sue A. Weaver
(74) *Attorney, Agent, or Firm*—Chapman and Cutler LLP

(57) ABSTRACT

A cover for protecting a head and/or adjacent shaft portion of a golf club is opened and closed by an over-center biasing means upon application of an external force to partly open or close the cover. The cover comprises a pair of wings adapted to be opened and closed about a longitudinal hinge formed between them and having a slot laterally formed in the pair of wings. Elongated elastic means such as rubber cords bias the pair of wings alternatively toward the open position and the closed position, by acting as an over-center device, passing through the slot openings at or adjacent the hinge and being fixed at both ends to the wings. A two-hinge form of the cover is also disclosed.

16 Claims, 3 Drawing Sheets

FIG. 1
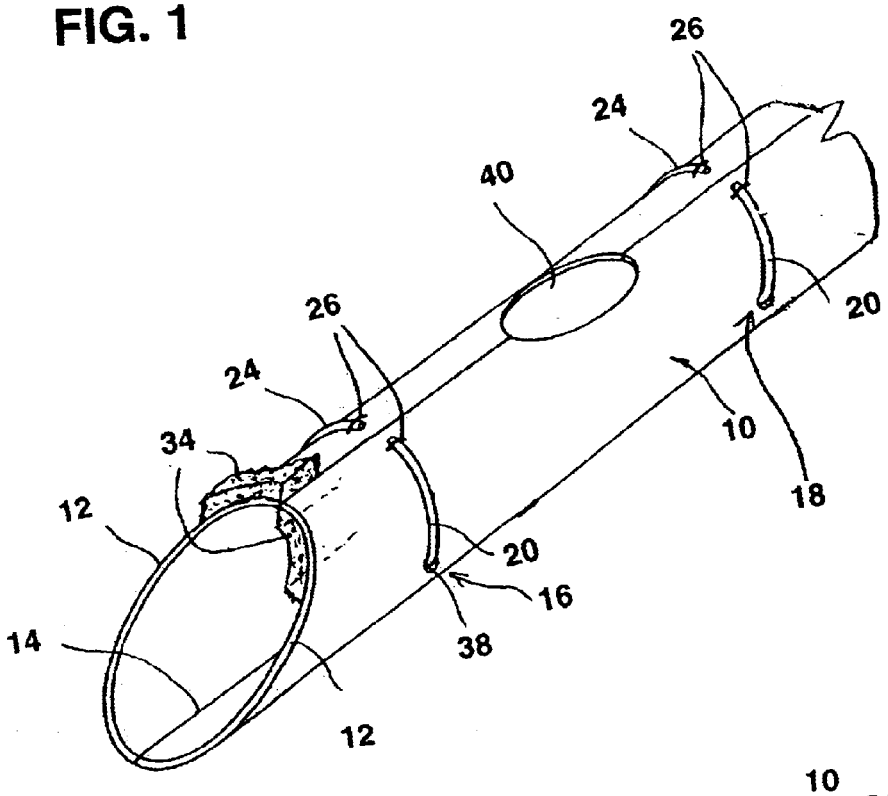
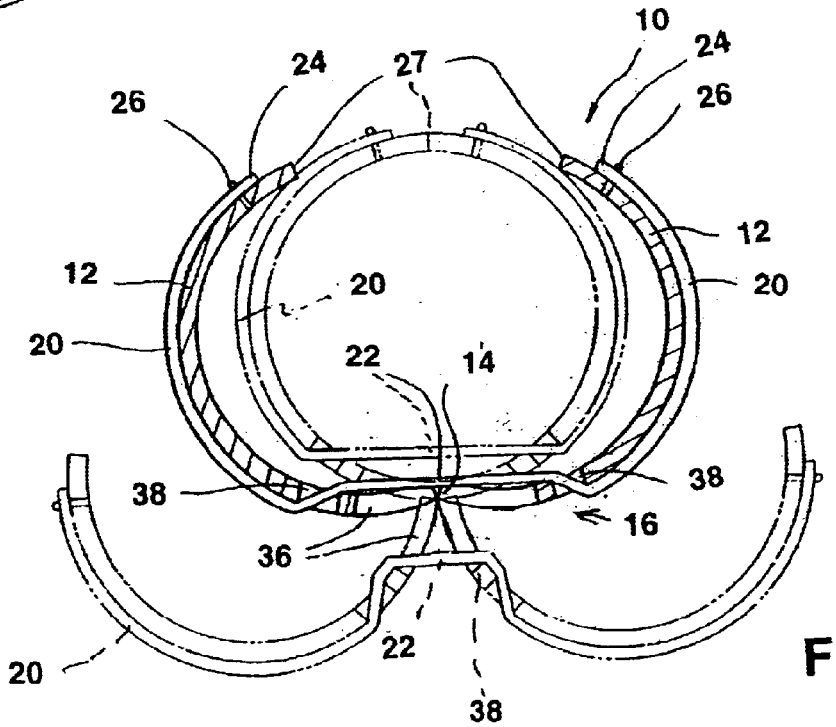
FIG. 2

BIASED, HINGED COVER FOR A GOLF CLUB

BACKGROUND OF THE INVENTION

1. Field of the Invention

This invention relates to covers for protecting golf club heads and/or adjacent shaft portions, wherein a cover is opened or closed by simple manipulation of hinged portions of the cover.

2. The Prior Art

A golf club comprises a wooden, metal, or composite head and a shaft joining to and extending from the head, and is typically carried in a golf bag together with a plurality of other golf clubs. Golf clubs vary among themselves in lengths, so clubs carried in a golf bag often have their heads and adjacent shaft portions come into contact with one another, scratching and damaging them. Protective covers are often used, which are carried either on the club heads alone or on both head and shaft portions to protect the clubs from one another. However, putting such protective covers onto the heads and shafts and detaching the covers for use of the clubs has heretofore been quite inconvenient. A number of head covers, operating in various ways, have been proposed to lessen such inconvenience.

Korean Patent Application No. 2001-63698, filed by the present inventor, seems the most advanced among the known head covers. It discloses a cover comprising a protective body of woven fabric that surrounds the golf club head and an adjacent shaft portion, a hinged frame carried within and supporting the woven body, and a pair of wings joined along a hinge between and extending along the frame. Springs are attached to inner surfaces of wing portions of the frame to urge or bias the frame to an open configuration. Such wings have facing free side edges fitted with cooperating locking means for selectively keeping the cover closed. The locking means comprises a hook and loop type fastener, magnetic means, or a Velcro® or other fastener.

Although a magnet may conveniently be used as the locking means, the magnet and cooperating iron strike piece are relatively expensive to buy and install and are not reliable in operation. Total cost of materials for manufacturing the whole cover is raised, so price competitiveness of the cover is lowered. The structure for attaching a magnet and plate is also complicated, so production of the cover is slow and labor-intensive. Moreover, a magnet requires a very short distance to its iron strike piece to create a sufficient attractive force between them. Often the magnet fails to lock the cover closed because the protective cover body, of woven cushioning fabric, comes between the mating pieces. In addition, the attracting force of the magnet is reduced over time, particularly if the cover is left open. Alternatively, it is very difficult to attach an elongated Velcro® fastener to long and narrow areas of both side edges of the frame, thereby again lowering productivity of workers making the covers. Furthermore, some users will avoid such closures due to the unpleasant ripping sound generated upon opening a Velcro fastener.

Other known head covers are less convenient to use and/or are more expensive to make than that noted above. The art has lacked a simple, inexpensive head and shaft cover for golf clubs that will protect such clubs from one another yet permit one-handed opening and closing of the cover.

SUMMARY OF THE INVENTION

Accordingly, an object of the present invention is to provide a cover for protecting a golf club head and/or adjacent shank, the cover being easily opened and closed and held in the open and closed positions by an elastic means such as a rubber or synthetic elastic cord without requiring any locking means, thereby permitting very easy, convenient manipulation of the cover.

It is another object of the present invention to provide a cover for protecting a golf club head and/or adjacent shank, the cover being moved between open and closed positions only by overcoming the tension of an elastic means, so the cover can be produced at significantly lowered cost and can be used over a long term without any loss of effectiveness, due to the very simple structure.

In order to accomplish the above objects, the present invention provides a cover for protecting a golf club head and/or shank portion that includes a hinged pair of wings opened and closed along at least one hinge, such as a living hinge, disposed between the pair of wings. The cover in one form further comprises slot openings laterally formed in the pair of wings, at points crossing the hinge line, and elastic means passing through the slots and fixed at both ends to the wings. The wings are elastically urged toward either the open position or the closed position, depending on which side of a center point the wings are located during an opening or a closing movement, as the elastic cord moves sideways through the slot and the hinge line.

The cover in another form has slot openings laterally formed in each of the pair of wings extending across the hinge line and a stopper at a mid point in or between the slot openings for preventing further inward movement of the elastic cord. The elastic cord passes through the slot openings and is fixed at both ends to the wings; it forms into a "V" shape upon being caught by the stopper as the wings are closed under tension of the cord acting on the wings.

BRIEF DESCRIPTION OF THE DRAWINGS

FIG. 1 is a perspective view of a cover for protecting a golf club according to a first embodiment of the present invention;

FIG. 2 is a cross-sectional view showing an intermediate position of the cover, between fully open and fully closed configurations shown in phantom, of the cover of FIG. 1;

DESCRIPTION OF THE PREFERRED EMBODIMENTS

Figure 3:
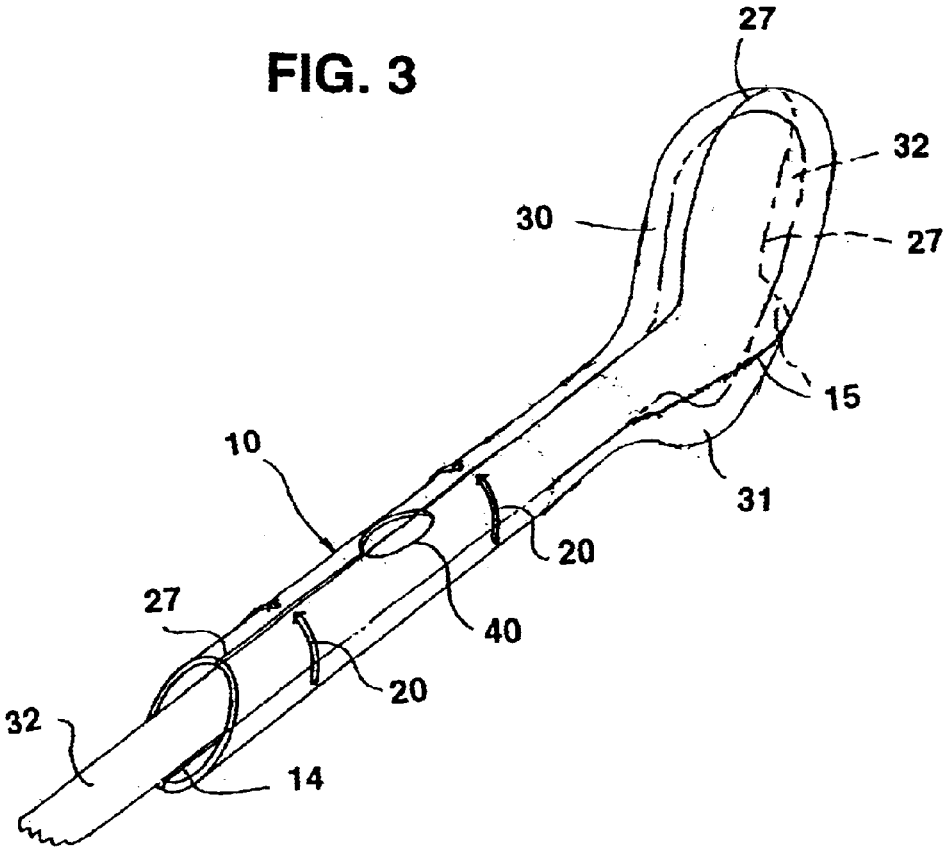
FIG. 3 is a perspective view of the cover of FIG. 1 of the present invention in a closed position, as applied to and closed on a head and shank of a golf club shown partly in phantom.

FIGS. 1 and 2 show a shank portion of a cover 10 for protecting a shank portion of a golf club according to a first embodiment of the present invention. The shank portion of the cover 10 comprises a pair of semi-cylindrical wings 12 adapted to be opened and closed about a longitudinal hinge 14 formed as a living hinge between the wings 12 and having a pair of sets of openings 16, 18 laterally formed in and through the pair of wings 12. Flexible, elastic cords 20 urge or bias the pair of wings 12 alternatively toward the open and closed positions, depending on whether the cord center 22 is located inside or outside the center portions of the openings 16, 18. Free ends 24 of the cords 20 are fixed to outer surfaces of the wings 12, as with stitches 26 or staples or the like, adjacent the free edges 27 of the wings 12.

In this and the other embodiments, although the cover 10 is shown as having a circular section along the shaft protective portion, it may alternatively have an elliptical or other section.

The shank portion of the cover 10 of the present invention, in all its embodiments, may be integrally coupled at an upper end to a head cover portion 30, which receives therein a head of a putter or other wooden, metal, or composite club 32, as shown in FIG. 3. In this case the hinge 14 continues along to or toward the heel 31 of the head cover portion. The heel is adapted as necessary so any opposed parts formed below the hinge 14 in the orientation of FIG. 3 do not interfere with one another in opening and closing the cover but can move freely past one another upon opening and closing the cover, as by dividing one side of the heel at the level of the hinge line, as at line 15, which passes about the heel 31 to the free edge 27 of the cover wing.

The cover 10 is illustrated in the drawings mostly without covering or interior lining for cushioning the club heads and shafts, but it may optionally be covered over all or any parts of its inner and/or outer surfaces with woven or other fabric or cushioning material 34, as shown mostly broken away at the left side of FIG. 1.

Moreover, although the cover 10 is shown in FIGS. 1–3 with only one hinge groove 14 formed directly between the two wings 12, the cover 10 may be provided with a pair of parallel living hinge grooves 314 or 414, as described below in connection with FIGS. 5 and 6.

The sets of openings 16, 18 permit reversal of the biasing effect of the elastic cords 20. In this first embodiment, of FIG. 1, a center portion 36 of each of the sets of openings 16, 18 allows the elastic cords 20 to move transversely, or sideways, through the line of the hinge 14, so the cords 20 are positioned above, or inwardly of, the hinge 14 in the closed condition and outwardly of the hinge 14 in the open condition, thereby causing the effect of the bias imposed on the wings 12 to be changed from holding the wings closed to holding the wings open, as in an over-center hinge device. The sets of openings 16, 18 are symmetrically formed in the pair of wings 12 with respect to the hinge groove 14. The sets of openings 16, 18 in this embodiment each comprise a main, central slot opening 36 allowing the elastic cord 20 to move sideways through it. Each of the sets of openings 16, 18 further comprise a smaller opening 38 spaced from an end of the main slot opening 36 for passing the elastic cord 20 lengthwise to allow its entire length, between attachments 26, 26 to apply biasing force to and between the wings 12.

In this first embodiment, although rubber or rubber-like cords are here described and shown in the drawings as the elastic means 20, other resilient means such as elastic synthetic cords or tension springs may be used.

The elastic or resilient means 20 is elastically deformed such that it exerts its tension force on the wings 12 to selectively urge them into the open or the closed position, depending on the relative positions of the wings 12. In this first embodiment, although both the ends 24 of each elastic cord 20 are shown in the drawing as fixed to distal ends of the wings 12, adjacent the free edges 27, as by binding stitches 26, the ends 24 may be fixed at other locations, for example at inner surfaces of the wings 12 or at outer surfaces immediately adjacent the small openings 38, depending on the nature of the elastic in the cords 20. Indeed, the elastic means 20 may be stitched or stapled to the inside of the wings 12 where the small openings 38 are positioned, dispensing with need for the small openings 38, although those openings are presently preferred.

In the FIG. 2 position of the shank portion cover 10 for protecting a golf club shank, according to the first embodiment of the present invention, since the center 22 of the elastic cord 20 is located inside the hinging line of the living hinge 14 when the cover 10 is closed, elastic force of the elastic cord 20 acts inwardly on the pair of wings 12, urging the cover 10 closed, so that distal edges 27 of the wings 12 are urged into contact with each other, as shown in the upper set of phantom lines. When external force is applied to the wings 12 to open the cover 10, either to the cylindrical surface or to edges of a finger hole 40 formed adjacent those distal edges 27, the elastic cords 20 pass sideways through the slot openings 36 and to a position outside of the line of hinge 14 from a position inwardly of that hinge, as shown in the lower set of phantom lines. When the elastic cord 20 passes through the line of hinge 14, elastic force of the elastic cord 20 acts on the wings 12 along the cord, biasing the wings 12 now to the open position and maintaining them in the open position without additional or continued external force. Opening of the cover 10 is effected by any simple manipulation, such as insertion of a finger into the opening 40 formed between the closed wings 12, and then pushing either wing outwardly away from the other. Once the wings 12 are opened sufficiently by manual force, then they are opened fully by the tension force of the elastic cord 20, acting below the hinge 14. The wings will open and wring toward one another until they contact one another or the elastic cord 20 becomes limp.

When the cover 10 is to be closed, the open wings 12 are manually pushed toward each other. As the elastic cord 20 passes sideways, upwardly through the line of hinge 14 and to the inside of the center slot openings 36, the wings 12 are then urged to the fully closed position by the elastic force of the cord 20, without additional external force. The wings are then maintained in the closed position by the force of the cord 20.

Figure 4:
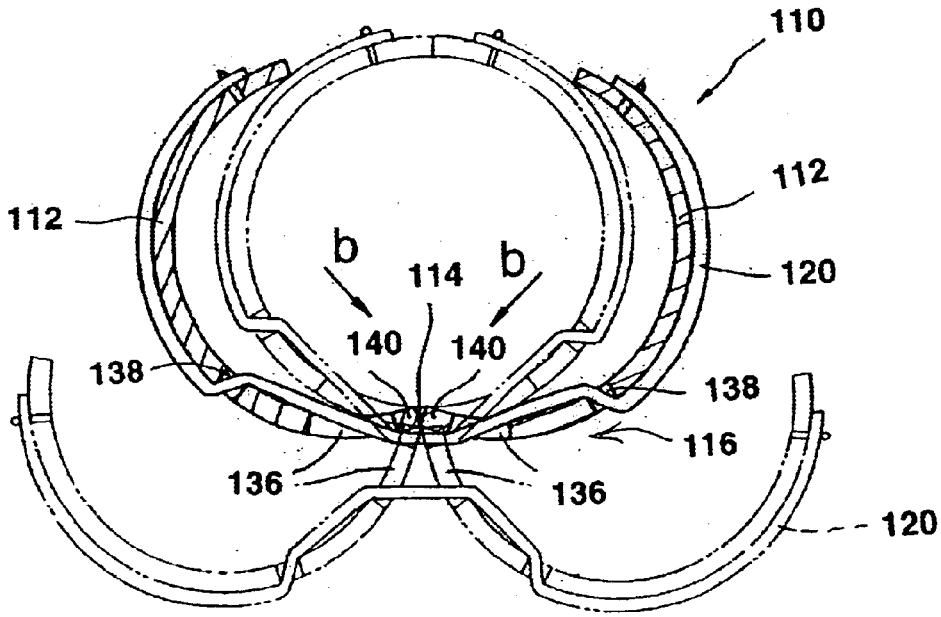
FIG. 4 is a cross-sectional view showing an intermediate position of a second embodiment of the present invention, between fully open and fully closed configurations shown in phantom.

FIG. 4 is a sectional view of a shank portion of a cover 110 for protecting a golf club head and/or shank according to a second embodiment of the present invention. Here, elastic means 120, both ends of which are fixed to wings 112, are positioned in a "V" shape when the wings 112 are closed, as in the upper part of the drawing, in phantom. As in the first embodiment, the set of openings, as 116, are laterally formed at a hinge 114 formed between the wings 112, but here the center, slot part 136 of each set of openings as 116 is left with a stopper 140 by which the elastic cord 120 is caught and formed into a "V" shape in the closed position of the cover 110. The sets of openings 116 each comprise a central slot opening 136 adapted to allow the elastic cord 120 to pass sideways through it except at the stoppers 140 at the hinge line 114. Smaller openings 138 disposed at both sides of the main slot opening 116 hold the elastic cord 120 in position on the wings 112 and pass its ends to the attachment points.

In the cover 110 according to this second embodiment of the present invention, since the wings 112 are biased toward the closed position by the "V"-shaped elastic cord 120, as indicated by arrows b, the wings 112 are maintained in the closed position shown in phantom in the upper center part of the Figure. When outward external force is applied to the wings 112, the wings 112 are moved to the open position. When the elastic cord 120 goes beyond a position exactly straight across the stoppers 140, it then moves downwardly and outwardly of the cover 112 under its own elastic biasing force, so the cover 110 is urged to its open position until the cord becomes limp or the wings contact one another. To close the wings 112, external force is manually applied to the wings 112. As they are moved toward the closed position by the external force, the elastic cord 120 is gradually straightened and then is caught by the stoppers 140. After the elastic cord 120 is fully straightened and would then pass inwardly of the hinge line, it subjects the wings 112 to an inward force as indicated by arrows b, so the wings 112 continue to move to the fully closed position.

Figure 5:
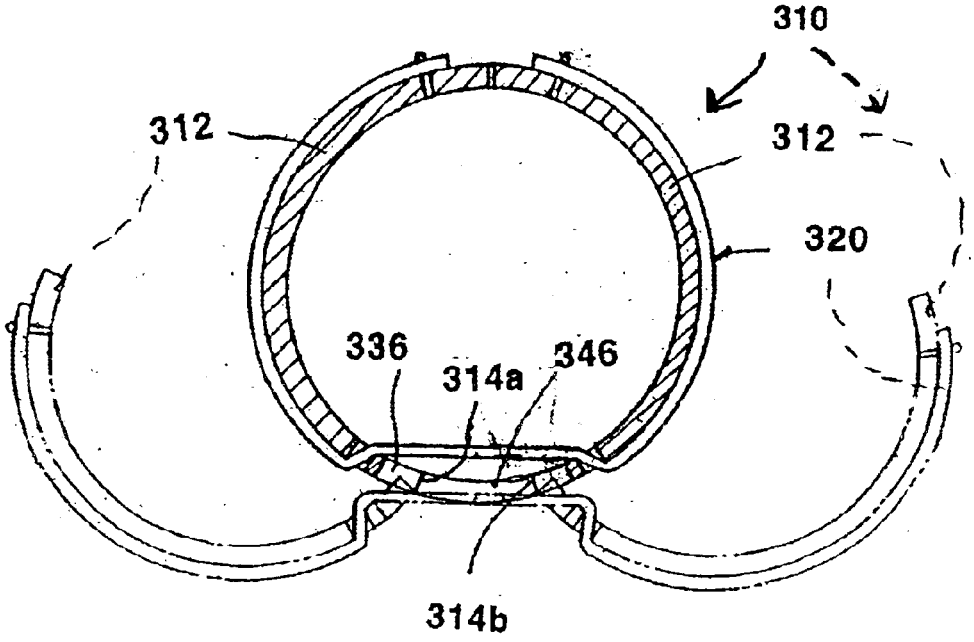
FIG. 5 is a cross-sectional view showing a closed configuration of a third embodiment of the present invention, with the open configuration shown in phantom.
Figure 6:
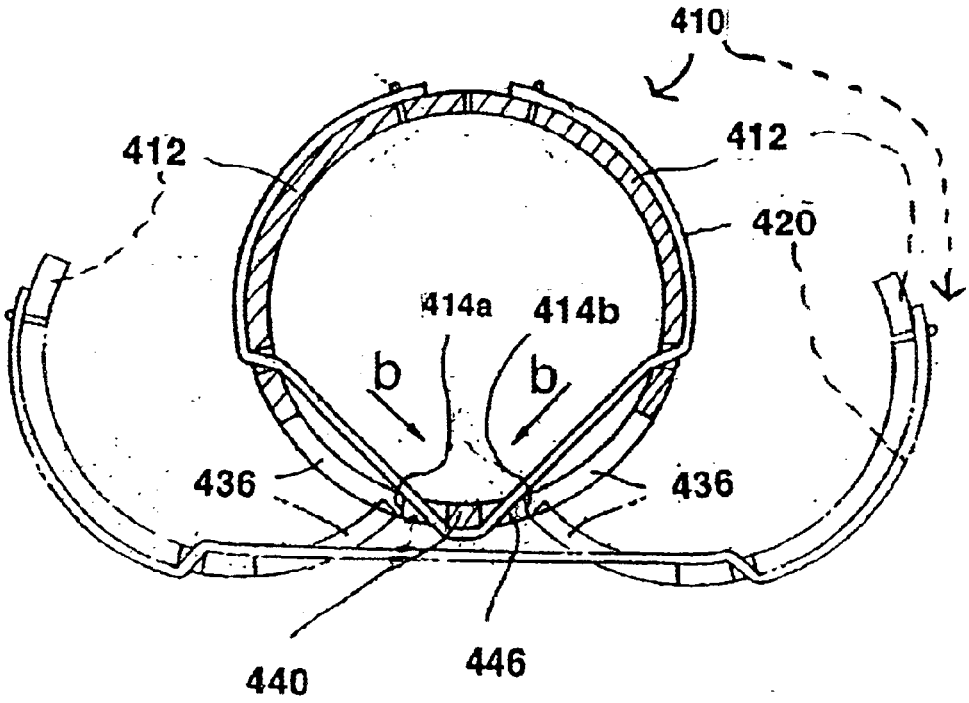
FIG. 6 is a cross-sectional view showing a closed configuration of a fourth embodiment of the present invention, with the open configuration shown in phantom

FIGS. 5 and 6 are cross-sectional views of club or shaft covers according to third and fourth embodiments of the present invention. Each of these covers is provided with two longitudinal hinges 314*a, b* and 414*a, b*, formed along parallel edges of a center member 346 or 446. Structure and operation of the covers 310 and 410 of the third and fourth embodiments are otherwise substantially similar to those of the above, first and second embodiments, respectively, in that the wings 312 and 412 are automatically opened and closed by the elastic means 320 and 420 fitted through the sets of openings 316 and 416 upon application of a small external force. The FIG. 5 embodiment, like the FIG. 1 embodiment, has no stopper for the elastic cord at the hinge line, while the FIG. 6 embodiment, like that of FIG. 4, has a stopper at 440.

As described above, the present invention provides a cover for protecting the head and/or just the shank of a golf club, the cover comprising a pair of wings having slot openings and elastic means passing through the slot openings and fixed at both ends to the wings for biasing the wings alternatively toward the open and closed positions. Since the wings are operated by the elastic means, the golf club cover can be easily opened and closed by slight manual force and maintained in the closed position without additional locking means. Furthermore, since the cover of the present invention has a very simple structure, the cover can be manufactured at significantly lowered cost and will function correctly for a long time.

Although preferred embodiments of the present invention have been described for illustrative purposes, those skilled in the art will appreciate that various modifications, additions and substitutions are possible, such as substituting any different hinge structure for the living hinges shown, without departing from the scope and spirit of the invention as defined in the accompanying claims.

What is claimed is:

1. A cover for selectively enclosing and protecting portions of a golf club, the cover comprising a pair of wings adapted to be alternatively opened apart and closed together, as about at least one of a head and adjacent shank portion of a golf club, about at least one hinge disposed between and joining the wings, wherein the cover further comprises:

at least one set of openings formed through the pair of wings, each of the sets of openings including a pair of small openings formed opposite one another, spaced apart across the hinge in the opposed wings, and also an elongated slot opening formed generally across each hinge and in both of the wings, the slot opening aligned with the openings of each said pair of small openings; and elongated elastic means passing through the small openings and fixed at either end to one of the pair of wings at positions spaced from the small openings, the elastic means being deformable between the small openings upon application of an external force to urge the wings alternatively toward one of an open position, for placing a portion of a club into the cover or removing it from the cover, and a closed position, with the club outside for use or partly inside for protected storage.

2. A cover as defined in claim 1, wherein the elastic means is most extended between the small openings when it is located immediately adjacent the hinge with the wings partly opened or partly closed.

3. A cover as defined in claim 1, wherein the elastic means extends both inside and outside the cover as the wings are respectively closed and opened.

4. A cover as defined in claim 1, wherein the elongated slot opening is formed as a continuous opening formed across and including the hinge, for allowing the elastic means to pass through a line of the hinge and inwardly and outwardly through the wings during opening and closing of the cover.

5. A cover as defined in claim 1, wherein the elongated slot opening is formed as a pair of elongated openings symmetrically formed across the hinge for allowing portions of the elastic means to pass sideways inwardly and outwardly through the wings during opening and closing of the cover.

6. A cover as defined in claim 5, wherein the cover comprises a pair of parallel hinges and a center member between the wings and the two hinges, and the elongated slot passes entirely across the center member and the hinges in the wings but includes a stopper for blocking movement of the elastic means at about the center of the center member.

7. A cover as defined in claim 5, wherein the cover comprises a pair of parallel hinges and a center member between the wings and the two hinges, and the elongated openings do not form any slot passing entirely across the center member.

8. A cover as defined in claim 1, in which the wings are at least partly covered with a cushioning material.

9. A cover as defined in claim 1, in which the wings are at least partly lined on their inside with a cushioning material.

10. A cover for protecting a head and/or adjacent shank portion of a golf club, the cover including a pair of wings adapted to open and close along at least one hinge disposed between the pair of wings under bias of an elongated elastic means extending between the wings, wherein the cover comprises:

at least one set of small openings formed laterally of the hinge in each of the pair of wings, and a slot extending generally across the hinge or hinges and between the small openings, the slot being thus positioned for passing at least portions of the elastic means sideways therethrough; and wherein said elastic means passes endwise through the small openings and is fixed at both ends to the wings beyond the small openings, the elastic means being most greatly elongated when the wings are partly opened, for urging the wings alternatively to the fully opened or fully closed positions.

11. A cover as defined in claim 10, further comprising a stopper formed at a mid point of the slot, between adjacent portions of the slot, the stopper limiting inward movement of the elastic means upon closing of the wings, and the elastic means being deformed generally into a "V" shape about the stopper when the wings of the cover are closed together.

12. A cover as defined in claim 11, in which a center of the elastic means moves normally to the hinge between an outermost position of the elastic means in the open position of the cover and an innermost position adjacent the stopper.

13. A cover as defined in claim 10, in which the slot comprises two portions symmetrically formed to a center line of the cover adjacent the hinge or hinges, and comprises a main slot for allowing the elastic means to pass inwardly and outwardly therethrough and smaller holes for holding the elastic means.

14. A cover as defined in claim 10, wherein the cover comprises two parallel hinges spaced apart along either side of a center member formed between the wings.

15. A cover as defined in claim 14, wherein the slot passes through and includes portions of the two hinges and the center member.

16. A cover as defined in claim 14, wherein the slot is formed as a spaced-apart pair of symmetric slots, each being formed in one of the wings and passing through one hinge and part of the center member, so that the elastic means is stopped at the center member and generally forms a V when the wings of the cover are closed.

* * * * *